United States Patent [19]

Moren

[11] 4,092,794

[45] June 6, 1978

[54] SAFETY DEVICE FOR GUNS

[76] Inventor: Robert D. Moren, 6411 W. Fremont Dr., Littleton, Colo. 80123

[21] Appl. No.: 770,838

[22] Filed: Feb. 22, 1977

[51] Int. Cl.[2] ..... F41C 27/00

[52] U.S. Cl. ..... 42/1 LP

[58] Field of Search ..... 42/1 LP

[56] References Cited

U.S. PATENT DOCUMENTS

| | | | |
|---|---|---|---|
| 3,027,674 | 4/1962 | Mahan | 42/1 LP |
| 3,208,176 | 9/1965 | Giles | 42/1 LP |
| 3,360,880 | 1/1968 | Finnegan | 42/1 LP |

*Primary Examiner*—Charles T. Jordan

*Attorney, Agent, or Firm*—Gary M. Polumbus

[57] ABSTRACT

The safety device of the present invention comprises a longitudinally extensible element adapted to be placed in one chamber of a revolver type gun so that the cylinder can be closed and the device positioned to extend through the chamber into the bore of the barrel to prevent the cylinder from rotating thus preventing the gun from being operated. The device is designed so that it must be rotated within the gun barrel to remove it from the gun so that individuals not knowing how the device operates cannot easily remove the device from the gun.

6 Claims, 7 Drawing Figures

SAFETY DEVICE FOR GUNS

BACKGROUND OF THE INVENTION

This invention relates generally to safety devices for weapons and more particularly to a safety device for a revolver type gun which can be inserted into the chamber of the gun cylinder to prevent firing of the gun.

Numerous accidents occur every year from accidental firing of firearms which are maintained at one's domicile usually for self protection. Guns are extremely hazardous in homes where children reside since they are generally not fully aware of the hazards of a loaded gun. The guns are normally maintained in a loaded condition since otherwise they would not be readily available for defense. To prevent accidental misfiring of such guns, devices have been developed for temporarily preventing a firearm from being operated.

Safety devices for guns to avoid the above noted hazards have taken numerous forms, two of which are disclosed in U.S. Pat. No. 3,027,674 issued to J. F. Mahan and U.S. Pat. No. 3,208,176 issued to J. E. Giles. The devices disclosed in these two patents are similar in that they consist of an expansible dummy type bullet adapted to be placed in the chamber of a revolver type gun and expansible to extend into the bore of the gun to prevent the cylinder from rotating and thus preventing the revolver from operating. As will be appreciated, however, from a review of the two above noted patents, neither device is very difficult to remove from the gun and, therefore, one with knowledge that the device was in the gun could easily remove it from the gun and it would, therefore, not be totally satisfactory as a safety device to prevent children from operating the gun.

SUMMARY OF THE INVENTION

The safety device of the present invention includes a base shell member in which a slide member is telescopically received and biased outwardly by a resilient member positioned within the shell. The device is adapted to be inserted into one chamber of a cylinder in a revolver type gun so that when the chamber is positioned in alignment with the bore of the barrel, the device will extend beyond the cylinder into the bore of the gun to prevent rotation of the cylinder and thus operation of the gun.

The shell and slide member are uniquely interconnected so that when the device is in use in a gun, the slide member cannot be compressed into the shell to allow the cylinder to be rotated or opened without rotating the slide member relative to the shell. In this manner, one not having knowledge of how the device operates would not be able to easily remove the device from a revolver type gun but one having knowledge of how the device operates could quickly and easily remove the device to render the gun operable.

Therefore, the device is not only well suited to prevent operation of a gun either inadvertently or intentionally by one who should not be operating the gun but is also uniquely designed so that it is difficult to remove from the gun, unless one has knowledge of its operation.

Other objects, advantages and capabilities of the present invention will become more apparent as the description proceeds taken in conjunction with the accompanying drawings.

DESCRIPTION OF THE PREFERRED EMBODIMENT

Figure 1:
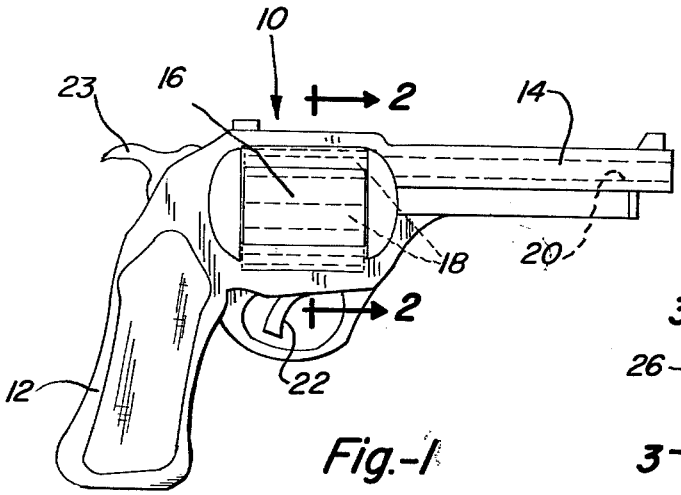
FIG. 1 is a side view of a handgun in which the device of the present invention can be used.
Figure 2:
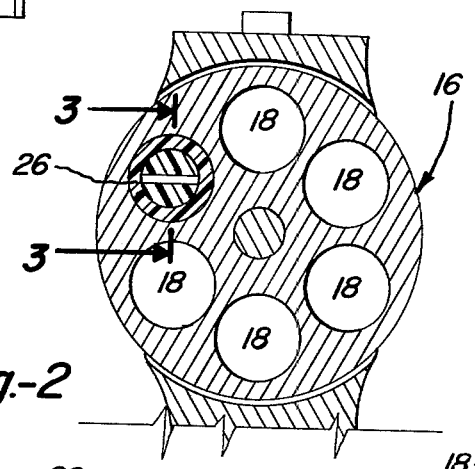
FIG. 2 is a fragmentary section taken along line 2—2 of FIG. 1.
Figure 3:
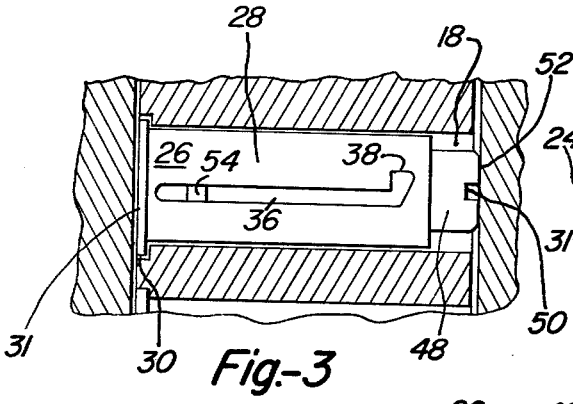
FIG. 3 is a fragmentary section taken along line 3—3 of FIG. 2.
Figure 4:
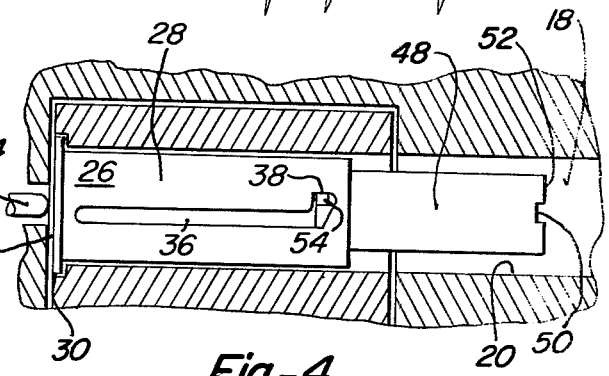
FIG. 4 is a fragmentary section through the gun of FIG. 1 showing the device of the present invention aligned with the bore of the gun.
Figure 5:
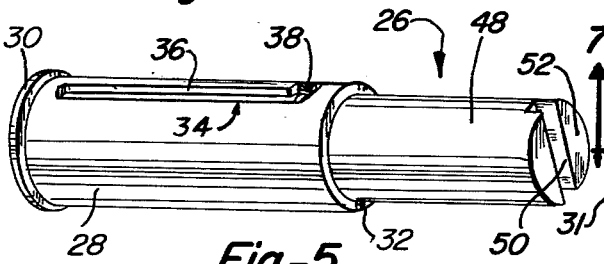
FIG. 5 is a perspective view of the device of the present invention.
Figure 6:
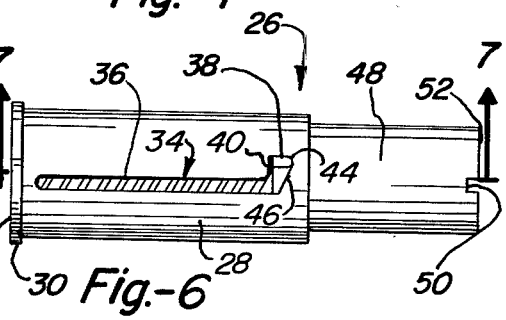
FIG. 6 is a side elevation of the device of the present invention in an expanded condition.
Figure 7:
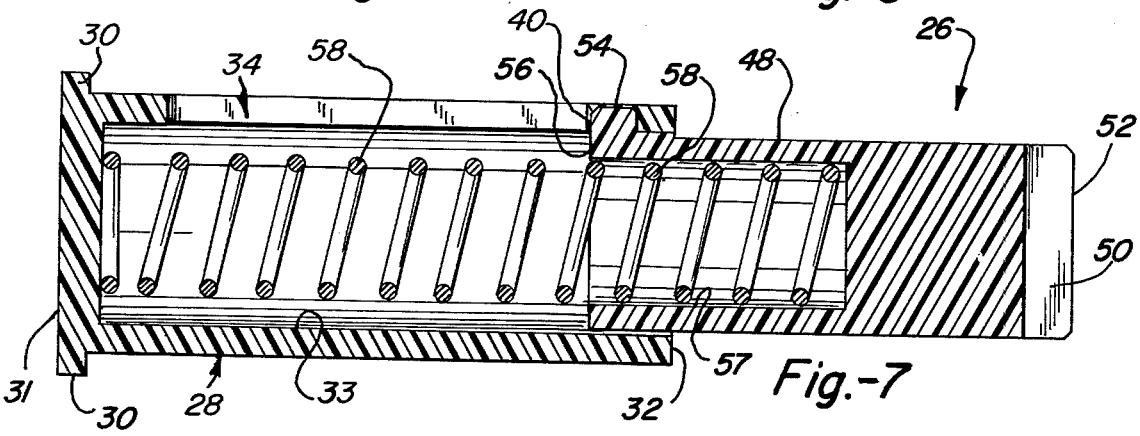
FIG. 7 is a section taken along line 7—7 of FIG. 6.

Referring first to FIGS. 1&2 a handgun 10 of the revolver type is illustrated and can be seen to include a handle portion 12 a barrel 14, and a revolvable cylinder 16 having a plurality of firing chambers 18 provided therein adapted to be placed in longitudinal alignment with the bore 20 in the barrel of the gun in sequence upon actuation of a trigger 22. As is conventional with such revolver type guns, each time the trigger is pulled the cylinder 16 is rotated to place a firing chamber 18 in alignment with the bore 20 and at the same time cock the hammer 23 and release the firing pin 24 on the gun so that if a bullet is in the firing chamber it will be fired in the chamber. It is readily apparent, that if the cylinder were prevented from rotating relative to the barrel of the gun that the gun would be rendered inoperable, and a safety device 26 of the present invention has been designed to capitalize on this feature of revolver guns to selectively prevent operation.

Referring to FIGS. 3 through 7, the safety device 26 of the present invention can be seen to include a hollow generally cylindrical shell 28 simulating the shell of a conventional bullet, having a peripheral flange 30 at its trailing end 31, an open leading end 32 and a hollow interior 33. A generally L-shaped slot 34 is formed in the cylindrical side wall of the shell with a first long leg 36 of the slot extending longitudinally of the shell, and a second short leg 38 extending circumferentially of the shell at the end of the longitudinal slot 34, closest to the open end 32 of the shell. The side edge 40 of the second leg 38 which is closest to the trailing end 31 of the shell is substantially straight and extends perpendicularly to the first leg 36 of the slot. This side edge 40 extends perpendicularly to a second side edge 44 of the second leg 38 which therefore extends parallel to the first leg 36 of the slot but at a location displaced circumferentially from the first leg. A side edge 46 of the second leg 38 which is closest to the open leading end 32 of the shell is tapered or bevelled to form a cam surface which extends away from the leading end of the shell when passing from the second side edge 44 of the slot.

A slide member 48 which is adapted to move axially in the shell 28 is a substantially solid cylindrical element having a groove 50 formed in its leading end 52 for a purpose to be described later and having a small guide or radial protrusion 54 at its trailing end 56. The trailing end also has an axial recess 57 formed therein which extends approximately half the length of the slide member for a purpose to be described later. The guide 54 has a width which is slightly less than the width of the first or longitudinal leg 36 of the slot in the shell 28 so that the guide will slide easily in the slot allowing the slide member 48 to be moved axially relative to the shell from a retracted position within the shell to an extended position wherein it protrudes axially out of the open leading end of the shell. The second or circumferential leg 38 of the slot, of course, is adapted to receive the guide 54 so that the slide element can be rotated relative to the shell. The cam or bevelled surface 46 is adapted to urge the guide into the second or circumferential leg 38 of the slot 34 as the slide member is moved from its retracted position into its extended position. When the guide is disposed in the second leg 38 of the slot, the slide member is prevented from being retracted or compressed into the shell by the guide abutting the first side edge 40. Of course, rotation of the slide member to place the guide in alignment with the first or longitudinal leg 36 of the slot will position the slide member so that it can be retracted into the shell by allowing the guide to slide along the longitudinal leg of the slot.

A resilient member 58, which in the preferred embodiment comprises a compression spring, is disposed within the shell 28 so that one end of the spring is abutted against the inner surface of the trailing end 31 of the shell and the opposite end against the inner end of the recess 57 in the slide member 48. The spring 58 of course biases the slide member into its extended position and yieldingly resists movement of the slide member into its retracted position.

In operation of the device, the cylinder 16 of a revolver type gun is opened in a conventional manner so that the firing chambers 18 in the cylinder are exposed for reception of bullets or in the present instance of the safety device 26 of the present invention. The safety device is inserted into a chamber 18 of the revolver and the slide member 48 is depressed into its retracted position within the shell 28. When the slide member is depressed into the shell, the overall length of the device is slightly less than the depth or length of a chamber in the cylinder so that the cylinder can then be closed into its operative position in the gun. After closing the cylinder, the cylinder is rotated in a conventional manner until the chamber having the safety device disposed therein is placed in alignment with the bore 20 of the gun at which moment the slide member under the bias of the compression spring, will automatically be extended into a position wherein it extends into the bore of the gun thereby providing a bridge between the bore and the chamber in the cylinder in which the device is disposed. With the device thus positioned, it will be appreciated that the cylinder of the gun cannot be rotated nor can the cylinder be opened to remove the device without first compressing the slide member so that it is fully retracted into the shell. Accordingly, if one were to pull the trigger of the gun with the device thus positioned, the cylinder would not rotate and the firing pin would not move rendering the gun inoperable.

To remove the device, a thin rod (not shown) which could take the form of a pencil is inserted into the bore of the gun from the opening leading end thereof and moved into engagement with the leading end 52 of the slide member 48. The groove 50 in the leading end of the slide member is adapted to receive a screw driver if this is the type of rod utilized. Upon engaging the leading end of the slide member, it is rotated in a direction to move the guide 54 on the trailing end of the slide member out of the circumferential leg 38 of the slot and then pressure is applied to the slide member to press it into its retracted telescoped position within the shell. With the slide member retracted within the shell, the cylinder of the gun can be rotated to remove the chamber in which the safety device is disposed from alignment with the bore in the barrel of the gun thus allowing the cylinder of the gun to be opened in a conventional manner and the device removed from the gun so that the gun can thereafter be operated in a conventional manner.

As will be appreciated, when using the safety device in a revolver type gun in the home, the device will prevent children from operating the gun and will also prevent adults from operating the gun who do not know the device is in the gun or do not know how to inactivate the device even though they are aware of its presence in the gun. However, one understanding the operation of the device can very quickly remove the device rendering the gun operable in the event it was needed.

Although the present invention has been described with a certain degree of particularity, it is understood that the present disclosure has been made by way of example and that changes in details or structure may be made without departing from the spirit thereof.

What is claimed is:

1. In a safety device for a gun having a firing pin, a barrel defining a bore, and a firing chamber for receiving ammunition in alignment with the bore of the barrel of the gun, said safety device including a generally cylindrical open ended shell element adapted to be placed in the firing chamber, a generally cylindrical slide member telescopically receivable in the shell element and resilient means for biasing the slide member outwardly of the shell element, the improvement comprising, means operatively interconnecting the shell element and slide member for selectively allowing and preventing relative axial movement by rotating the shell element and slide member relative to each other, said interconnecting means including a generally L-shaped slot in the cylindrical wall of one of said shell element and slide member and a protrusion on the cylindrical wall of the other of said shell element and slide member with the protrusion adapted to protrude into said slot to control the relative rotative positions of the shell element and slide member.

2. In the safety device of claim 1, said slot being a closed slot so that the operative relationship of the slot and protrusion serves to hold the slide member in the shell element.

3. In the safety device of claim 2, said slot having a first leg extending longitudinally of the element in which it is formed and a second leg extending generally perpendicularly to said first slot such that when said protrusion is positioned in said second leg of the slot the shell element and slide member will be retained in an extended relationship but when the protrusion is in the first leg of the slot the shell element and slide member will be longitudinally movable relative to each other.

4. In the safety device of claim 3, said slot being formed in the shell element with the second leg of the slot being adjacent to the open end of the shell element through which the slide member is movable.

5. In the safety device of claim 4, said device further including a cam surface at the juncture of the first and second legs of said slot, said cam surface cooperating with said resilient means in urging the protrusion into the second leg of the slot when said shell element and slide member are in an undisturbed condition.

6. In the safety device of claim 5 wherein said resilient means comprises a compression spring retained in said shell element to bias the slide member outwardly of the end of the shell element through which it protrudes.

* * * * *